US006059030A

United States Patent [19]

Celestine

[11] Patent Number: 6,059,030

[45] Date of Patent: May 9, 2000

[54] SAND RECOVERY UNIT

[76] Inventor: Joseph W. Celestine, 1276 Anse Broussard Hwy., Breaux Bridge, La. 70517

[21] Appl. No.: 09/149,345

[22] Filed: Sep. 8, 1998

[51] Int. Cl.[7] ..... E21B 37/00; E21B 21/00

[52] U.S. Cl. ..... 166/105.1; 166/227; 166/311

[58] Field of Search ..... 166/105.1, 105.3, 166/311, 227, 69, 74; 417/1, 12, 44.1

[56] References Cited

U.S. PATENT DOCUMENTS

| | | | |
|---|---|---|---|
| 3,581,027 | 5/1971 | Lindsay | 200/33 R |
| 4,018,282 | 4/1977 | Graham et al. | 166/278 |
| 4,018,283 | 4/1977 | Watkins | 166/278 |
| 4,021,150 | 5/1977 | Mabuchi | 417/411 |
| 4,046,198 | 9/1977 | Gruesbeck et al. | 166/278 |
| 4,127,173 | 11/1978 | Watkins et al. | 166/276 |
| 4,711,299 | 12/1987 | Caldwell et al. | 166/105.1 |
| 4,924,940 | 5/1990 | Burroughs et al. | 166/105.1 |
| 4,940,092 | 7/1990 | Ferguson et al. | 166/311 |
| 5,062,484 | 11/1991 | Schroeder, Jr. et al. | 166/278 |
| 5,095,976 | 3/1992 | Appleton | 166/105.1 |
| 5,139,089 | 8/1992 | Wacker | 166/311 |
| 5,287,923 | 2/1994 | Cornette et al. | 166/278 |

*Primary Examiner*—David Bagnell
*Assistant Examiner*—Jennifer R. Dougherty
*Attorney, Agent, or Firm*—Henderson & Sturm LLP

[57] ABSTRACT

A sand recovery unit for removing sand and other clogging debris from a producing well formation including a cylinder tube component housing an interior filter located across an intake; a DC motor coupled to a pumping mechanism having an intake covered by the filter and discharge orifices along the side wall of the tube; and a one-way flap valve provided in-line with the interior filter in a manner such that the inline flap valve is positioned on an opposite side of the filtering screen from the pumping mechanism. A coupling is also provided for attachment to a drill string and a chargeable ni-cad battery supply is provided for powering the pumping mechanism.

2 Claims, 2 Drawing Sheets

SAND RECOVERY UNIT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of well drilling accessories, and more particularly to a sand recovery unit for a well drilling hole.

2. Description of Related Art

As can be seen by reference to the following U.S. Pat. Nos. 5,287,923; 5,062,484; 4,127,173; 4,046,198; 4,018,283; and 4,018,282 the prior art is replete with myriad and diverse well drilling accessories.

While all of the aforementioned prior art constructions are more than adequate for the basic purpose and function for which they have been specifically designed, they are uniformly deficient with respect to their failure to provide a simple, efficient, and practical sand recovery unit for a well drilling hole.

As a consequence of the foregoing situation, there has existed a longstanding need for a new and improved sand recovery unit and the provision of such a construction is a stated objective of the present invention.

BRIEF SUMMARY OF THE INVENTION

Briefly stated, the present invention provides a sand recovery unit for removing sand and other clogging debris from a producing well formation including a cylinder tube component housing an interior filter located across an intake; a DC motor coupled to a pumping mechanism having an intake covered by the filter and discharge orifices along the side wall of the tube; and a one-way flap valve provided in-line with the interior filter in a manner such that the in-line flap valve is positioned on an opposite side of the filtering screen from the pumping mechanism. A coupling is also provided for attachment to a drill string and a chargeable ni-cad battery supply is provided for powering the pumping mechanism.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
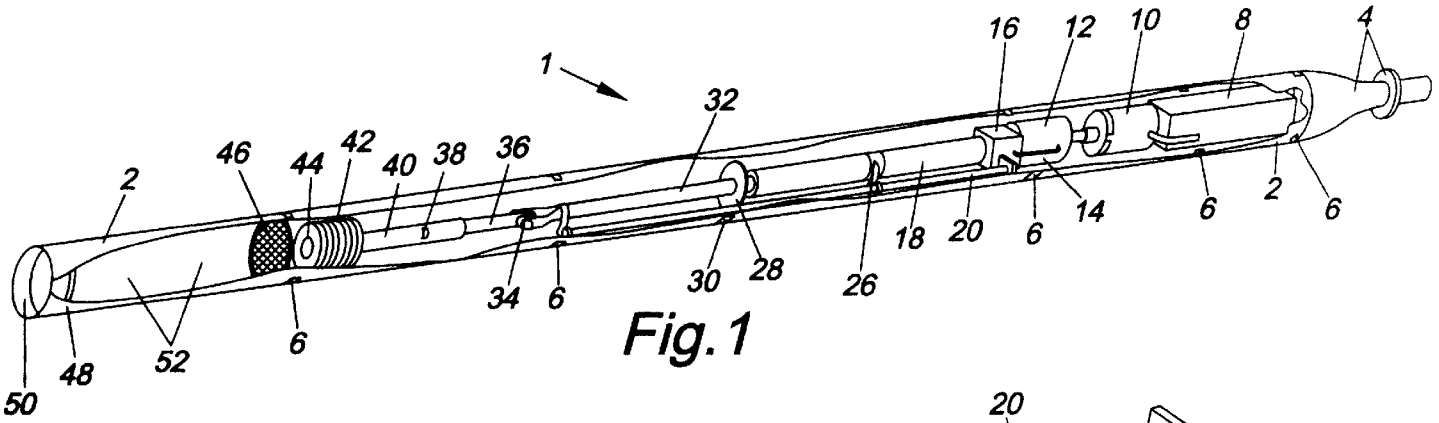
FIG. 1 is a perspective view of the sand recovery unit of the present invention with portions cut away to show the internal components.
Figure 5:
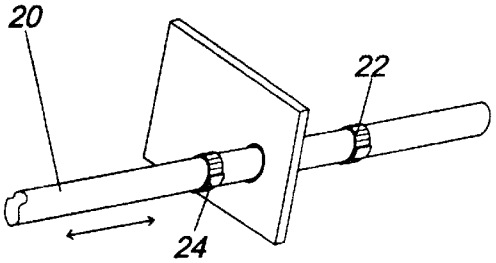
FIG. 5 is an enlarged perspective view showing the adjustable stops for the upstroke and down-stroke.

As can be seen by reference to the drawings, and in particularly to FIG. 1, the sand recovery unit that forms the basis of the present invention is designated generally by the reference number 1. The sand recovery unit 1 includes a case/chassis component 2 having fixtures or attachments which allow attachment of the following parts; the threaded connector/drill pipe attachment/switch sensor assembly 4, the threaded section with O-ring seal 6, the battery 8, the D.C. drive motor 10, the hydraulic pump 12, the hydraulic fluid line 14, the hydraulic reversing valve 16, the hydraulic cylinder, pump drive 18, the reversing shaft to hydraulic reversing valve 20, the adjustable reversing stop for the down stroke 22, the adjustable reversing stop for the up-stroke 24, the reversing shaft guide 26, the pump seal/partition 28, the first pump exhaust port 30, the hydraulic cylinder, shaft drive to pump connection 32, the bolt connection of the hydraulic cylinder to pump shaft 34, the piston pump connect shaft 36, the second pump exhaust port 38, the ball valve assembly 40, the plunger component 42, the piston pump input opening 44, the multiple layer filter 46, the flap valve 48, the unit intake 50, and the sand collection area 52.

The design of the sand recovery unit 1 is that of a device that removes mud/sand build-up from drilling holes using a self-contained battery powered mechanism. The sand recovery unit 1 is designed to activate once it detects it has reached the bottom of the well, thereby conserving battery power. The sand recovery unit 1 works under the principle of positive suction and is a self-contained device that operates by utilizing a plunger type pump assembly inside of an associated tube. A hydraulic cylinder, powered by means of a battery/motor driven hydraulic pump, reciprocates automatically through the use of a reversing hydraulic valve that is controlled by the oscillating movement of the hydraulic cylinder. The sand recovery unit 1 utilizes a filter, flap valve, and associated pump exhaust ports in order to pump sand into a contained area inside the sand recovery unit 1 while removing associated water. The primary function of the sand recovery unit 1 is to remove the mud or sand build-up from inside the bottom of a well.

Again, referring to FIG. 1, the sand recovery unit 1 is a cylindrical-shaped assembly that is screwed together in watertight sections 6. The sand recovery unit 1 attaches to the end of a conventional drill pipe, as used in the oil field industry. The sand recovery unit 1 pumps mud or sand from the bottom of a well hole, utilizing an internal, battery power source 8. The replaceable battery, similar to the type used in the oil field industry today, powers a DC gear motor 10, whose output shaft is directly connected to a hydraulic pump assembly 12. The hydraulic pump assembly powers a conventional dual-action hydraulic ram/piston assembly 32. The piston oscillates, or moves, back and forth automatically, by means of a hydraulic diverter valve that is controlled by an external valve switching linkage or panel. The switching linkage is controlled by a separate metal rod 20, that is attached to the end of the hydraulic pump shaft 32. In operation, the end of the hydraulic pump shaft will change the direction of the pump hydraulic fluid from the hydraulic pump, to either the top end of the hydraulic ram, or the bottom end of the hydraulic ram. This means that whenever the hydraulic ram reaches its fully extended position (pump at total down-stroke), a stop clamp 22, located on the shaft assembly, causes the linkage or paddle on the reversing switch to move in the opposite direction it was originally in (toward the pump assembly), causing the pressurized hydraulic fluid to be diverted to the opposite end of the hydraulic ram assembly.

Because hydraulic fluid is now being pumped from the opposite direction of the hydraulic ram, the ram reverses direction, moving the pump piston in the up-stroke direction. Upon completing this cycle (total piston up-stroke), a second clamp assembly 24, located on the reversing shaft 20, moves the linkage on the hydraulic reversing valve in the opposite direction, causing hydraulic fluid to be pumped into the hydraulic ram in the opposite direction it was previously pumped, causing the ram to reverse direction once again.

Figure 2:
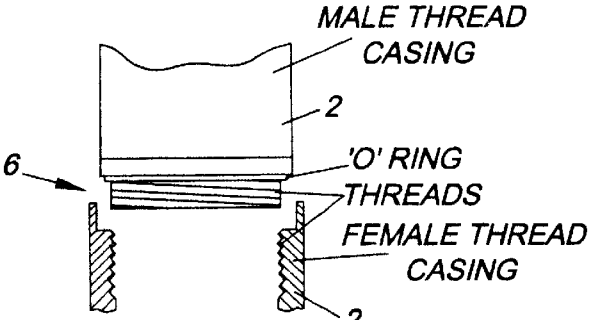
FIG. 2 is an enlarged partial sectional view showing the watertight connection of sections of the case component.
Figure 4:
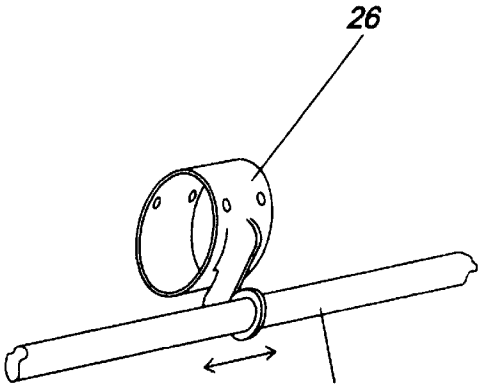
FIG. 4 is an enlarged perspective view showing the reversing shaft guide.
Figure 3:
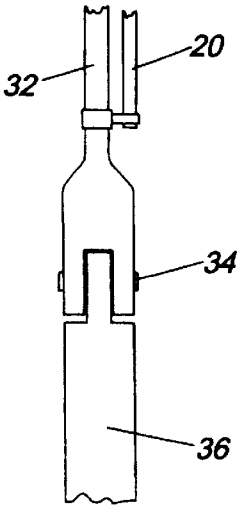
FIG. 3 is an enlarged perspective view of the bolt connection of the hydraulic cylinder to the pump shaft.

The end of the hydraulic ram is directly connected to the piston pump assembly, and is directly powering the piston of the pump assembly to move up and down. This method of moving the pump up and down provides automatic operation of the pump assembly while it is in the well. Access to all of the internal components within the casing of the sand recovery unit 1 is provided by the previously mentioned, screwed-together casing sections 2, that are made watertight via O-ring seals which may be seen in FIG. 2. A guide for the reversing shaft 26, connected to the end of the hydraulic ram, is provided in order to keep alignment straight with the hydraulic reversing valve. The end of the pump unit utilizes a seal assembly that allows the pump to maintain pressure and seal off fluids from the rest of the mechanisms in the sand recovery unit 1, beginning with the end of the hydraulic ram, all the way to the motor assembly. All of the pumped solids are collected in a cylinder section located near the suction end 50 of the sand recovery unit 1. A filter unit 46, filters out the solids, such as sand and mud, from the liquids. The liquids are pumped away from the solids. The solids are removed by unscrewing the O-ring sealed section at the bottom portion of the sand recovery unit 1.

Figure 6:
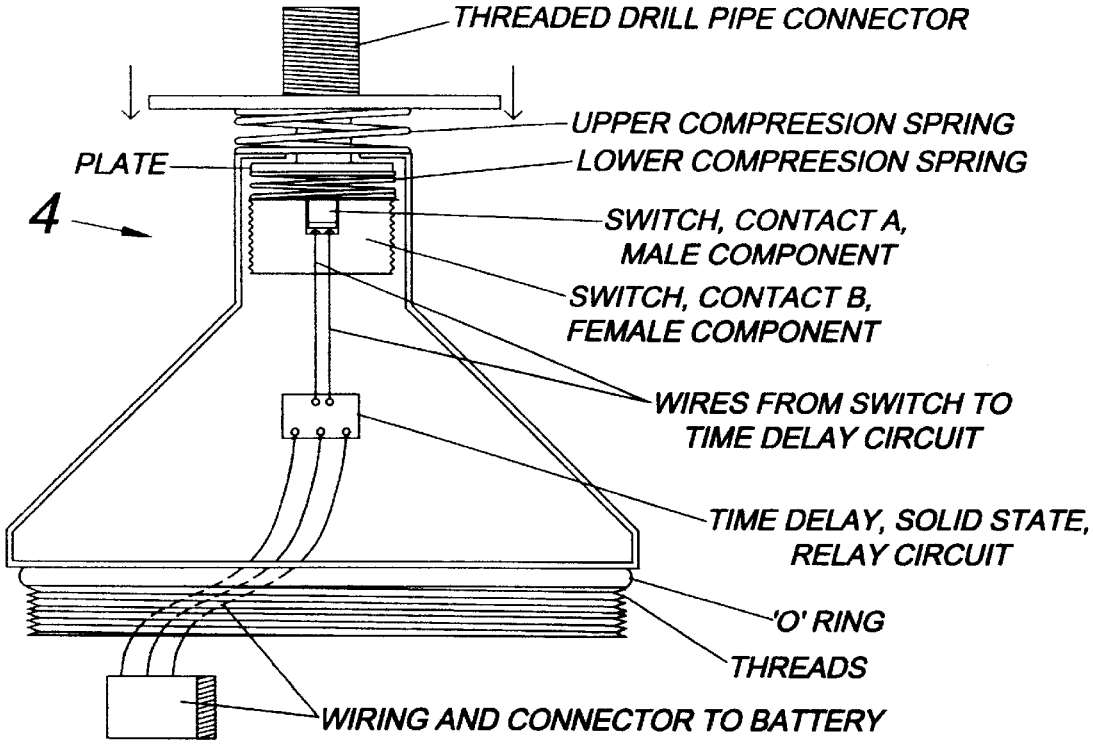
FIG. 6 is an enlarged side elevation sectional view of the drill pipe connector-switch assembly.

FIG. 6 shows the threaded drill pipe connector/switch assembly that screws on to the very upper portion of the sand recovery unit 1 as illustrated in FIG. 1. The function of this assembly is to detect the bottom of the well as the sand recovery unit I is moved downward into the well hole. The threaded drill pipe connector is spring loaded by means of the upper compression spring and moves in a downward position whenever the end of the sand recovery unit 1 meets the bottom portion of the well. A male switch contact is a part of this assembly, and moves downward, mating with the female switch contact. The lower compression spring is seated between the plate and the chassis for the female switch contact. Both compression springs work together to provide a solid weight bearing switch assembly with an automatic return whenever downward pressure from the drill pipe is removed.

Upon hitting the bottom of the well hole, the upper portion of the threaded drill pipe connector and its associated plate push downward by the force of the drill pipe coming between this assembly and the very end of the sand recovery unit 1. Upon making contact, the switch assembly activates a time-delay solid state relay circuit. The time delay relay may be set to stay in the "on" position for as long as is desired by the manufacturer, 5 to 10 min. for example. This means that whenever the sand recovery unit 1 hits the bottom of the well, it will not be turning on and off due to variations in pressure or otherwise wasting battery power, but rather once turned on, the time delay solid state relay will keep the entire DC motor assembly active for the pre-set determined time delay. The output of the time delay relay connects via external wiring and an external waterproof connector to the battery/motor unit. Even though this entire assembly is made waterproof via the O-ring seal, the inside hollow areas of the assembly may be filled with a foam material in order to protect the time relay solid state relay circuit from any physical shock.

Figure 7:
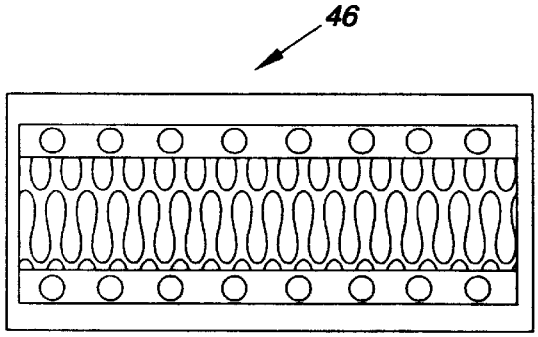
FIG. 7 is an enlarged side elevation sectional view of the screen filter assembly.
Figure 8:
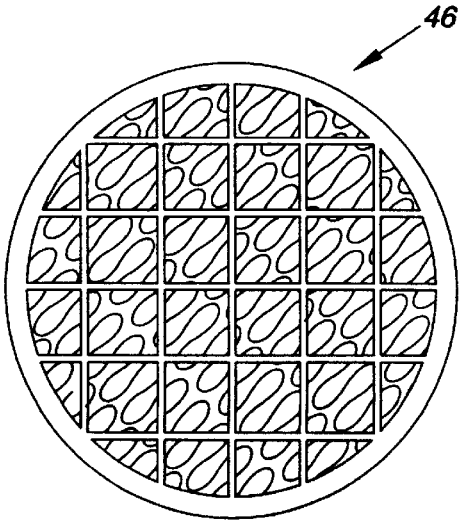
FIG. 8 is an enlarged bottom sectional view showing the filter assembly.

As can be seen in FIGS. 7 and 8, the screen filter assembly consists of a primary hardware cloth component at the very top and very bottom with a center section consisting of steel wool, The holes in the screen of the hardware cloth are approximately ¼" openings. These three metal components, the two screens, top and bottom, and the included steel wool center section, are all held together as an assembly by an upper and lower case component that contains the entire filter, making it an easy-to-replace assembly. The outer case component would be best manufactured of stamped steel, but may also be manufactured of glass-filled ABS, injection molded plastic.

Referring to the pump operation, as the plunger assembly moves in a downward motion, water (liquid) will enter the hollow center at the opening of the piston assembly, with the liquid pressure pushing upward to the ball valve unit. The water (under pressure), exits the second exhaust port into the hollow chamber. The hollow chamber changes volume as the plunger pushes downward, since the chamber is defined as the point between the hydraulic end rod and the top of the plunger. On the downstroke, water pulled into the unit from the up-stroke cycle, is contained.

On the up-stoke, the contained water (liquid) slurry exits from the first exhaust port into the hollow wall created by the main unit and the outer sleeve of the unit. The water flows down the hollow wall and re-enters the intake of the sand recovery unit 1 near the flapper valve.

In use, a worker places the opposite end of the sand recovery unit 1 into the drilled well hole and works it into the ground. The sand recovery unit 1 is then turned on automatically whenever it hits the end or bottom of the well hole. This action provides the suction of sand from the hole, releasing the sand outward from the associated exhaust port. The filter component catches sand, mud and objects too large for the sand recovery unit 1 to handle, keeping it from becoming damaged and collecting the sand, mud or debris in the front area of the sand recovery unit 1. Once full, the sand recovery unit 1 is pulled to the surface, the watertight seal unscrewed and the debris removed. Any and all components, including the battery, may be serviced by unscrewing the watertight O-ring seals located throughout the illustrated length of the sand recovery unit 1. The sand recovery unit 1 may be manufactured in a variety of sizes or lengths as required. All selected components must be able to withstand the pressures and temperatures that are present within a well system where this invention is to be used.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A sand recovery unit for removing sand from the bottom of a producing well, comprising:

an elongated cylindrical case having a top end attached to a drill string and a bottom end in contact with the bottom of a well;

a battery powered pump disposed within the case and having a suction inlet in communication with the bottom of the well;

a filter disposed within the case below the pump suction inlet;

a chamber defined by the interior of the case below the filter; and a flap check valve disposed within the case adjacent the bottom end of the case;

further including a switch assembly disposed within the case adjacent to the top end, the switch assembly including a compression spring biasing switch contacts in an open position, wherein the contacts are closed to activate the pump when the case is displaced upwardly after contact with the bottom of the well.

2. The sand recovery unit of claim 1, wherein the switch assembly includes a time delay set to continue activation of the pump for a predetermined time after contact of the case with the bottom of the well.

* * * * *